US005641261A

United States Patent [19]

Talbert et al.

[11] Patent Number: 5,641,261

[45] Date of Patent: *Jun. 24, 1997

[54] FORK LIFT TRUCK

[75] Inventors: Donald Talbert, Colorado Springs, Colo.; Robert Patterson, Bastrop; Arnold C. Cuba, Jr., Taylor, both of Tex.

[73] Assignee: Taylor Iron-Machine Works, Inc., Taylor, Tex.

[ * ] Notice: The term of this patent shall not extend beyond the expiration date of Pat. No. 5,480,275.

[21] Appl. No.: 478,862

[22] Filed: Jun. 7, 1995

Related U.S. Application Data

[63] Continuation-in-part of Ser. No. 137,345, Oct. 18, 1993, Pat. No. 5,480,275.

[51] Int. Cl.[6] ..... B66F 9/10

[52] U.S. Cl. ..... 414/544; 280/6.12; 280/766.1; 187/226; 414/635; 414/664

[58] Field of Search ..... 414/467, 544, 414/628–638, 662–664, 668, 786; 187/226; 280/763.1, 764.1, 765.1, 766.1, 840, 6.1, 6.12, DIG. 1

[56] References Cited

U.S. PATENT DOCUMENTS

| | | | |
|---|---|---|---|
| 2,897,985 | 8/1959 | Carlson et al. | 414/544 |
| 3,834,731 | 9/1974 | Uehara | 280/766.1 |
| 4,365,921 | 12/1982 | Brouwer et al. | 414/631 X |
| 4,921,075 | 5/1990 | Schumacher et al. | 414/663 X |
| 5,171,124 | 12/1992 | Foster | 280/763.1 X |
| 5,437,531 | 8/1995 | Kress | 280/766.1 X |
| 5,480,275 | 1/1996 | Talbert et al. | 187/226 X |

FOREIGN PATENT DOCUMENTS

| | | | |
|---|---|---|---|
| 238097 | 5/1964 | Austria | 414/631 |
| 1395966 | 3/1965 | France | 414/631 |
| 1950633 | 4/1971 | Germany | 414/544 |
| 8300147 | 8/1984 | Netherlands | 414/631 |
| 190268 | 6/1967 | U.S.S.R. | 414/631 |

*Primary Examiner*—David A. Bucci
*Attorney, Agent, or Firm*—Penrose Lucas Albright

[57] ABSTRACT

A fork lift truck having a "lazy tong" or "scissor-like" horizontal motion control system attached to the mast carriage which allows the load carried by the mast to be retracted from forward of the front wheels to between the front and rear wheels and to be extended in a reverse fashion. Also, two horizontally and vertically forward-extending outriggers are deployed independently of each other with consideration to the terrain, obstacles, the load and other factors to prevent the truck from tilting forward in response to a load on the tines while the tines are extended forwardly and the truck is not traveling.

5 Claims, 9 Drawing Sheets

FIG. 1a
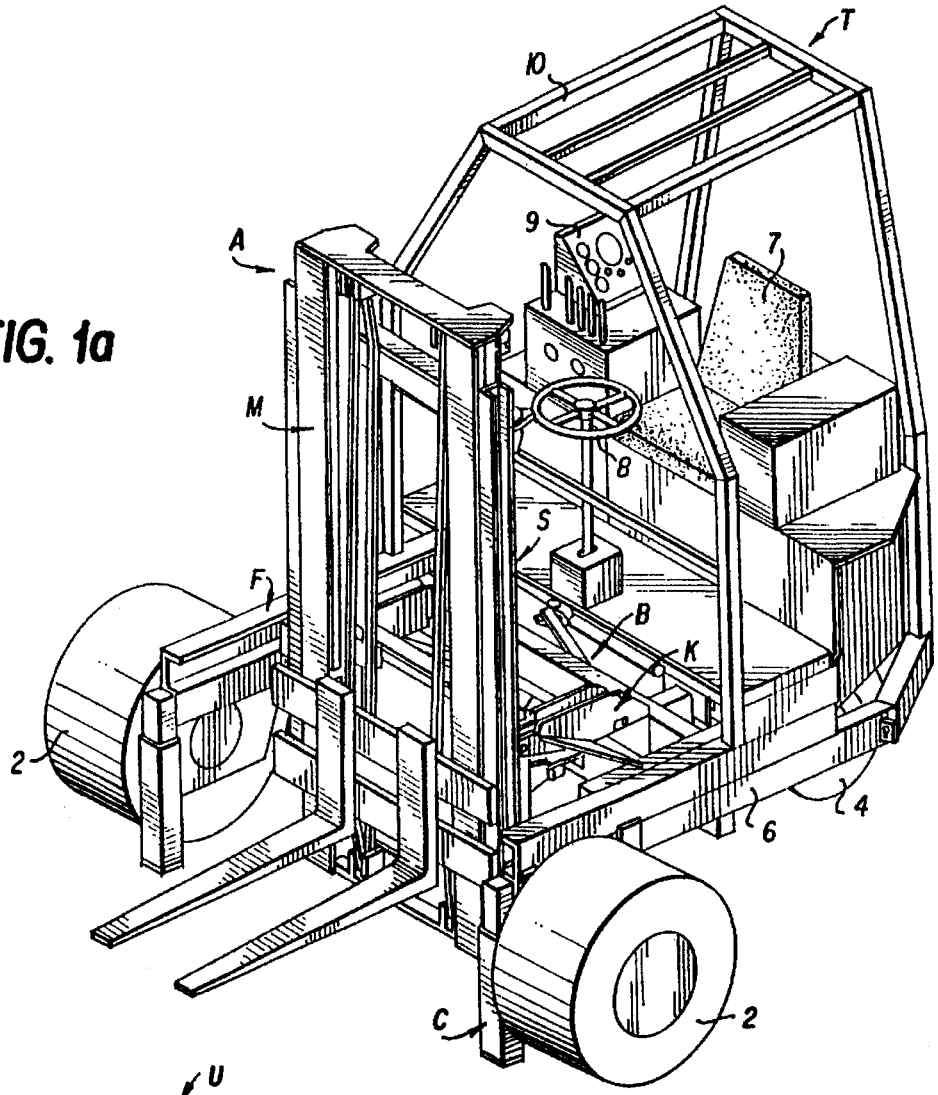
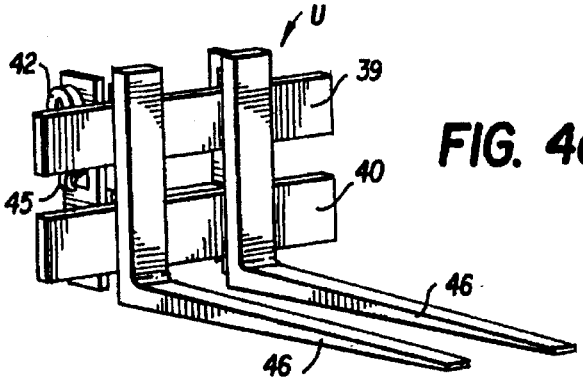
FIG. 4a
FIG. 4b
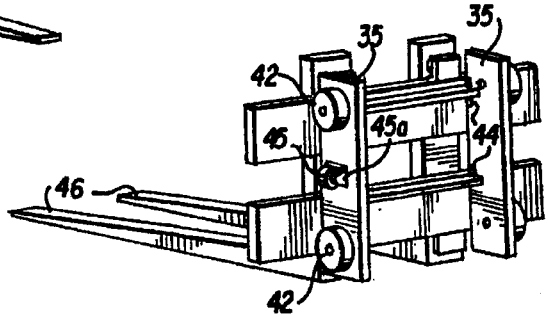

FIG. 1b
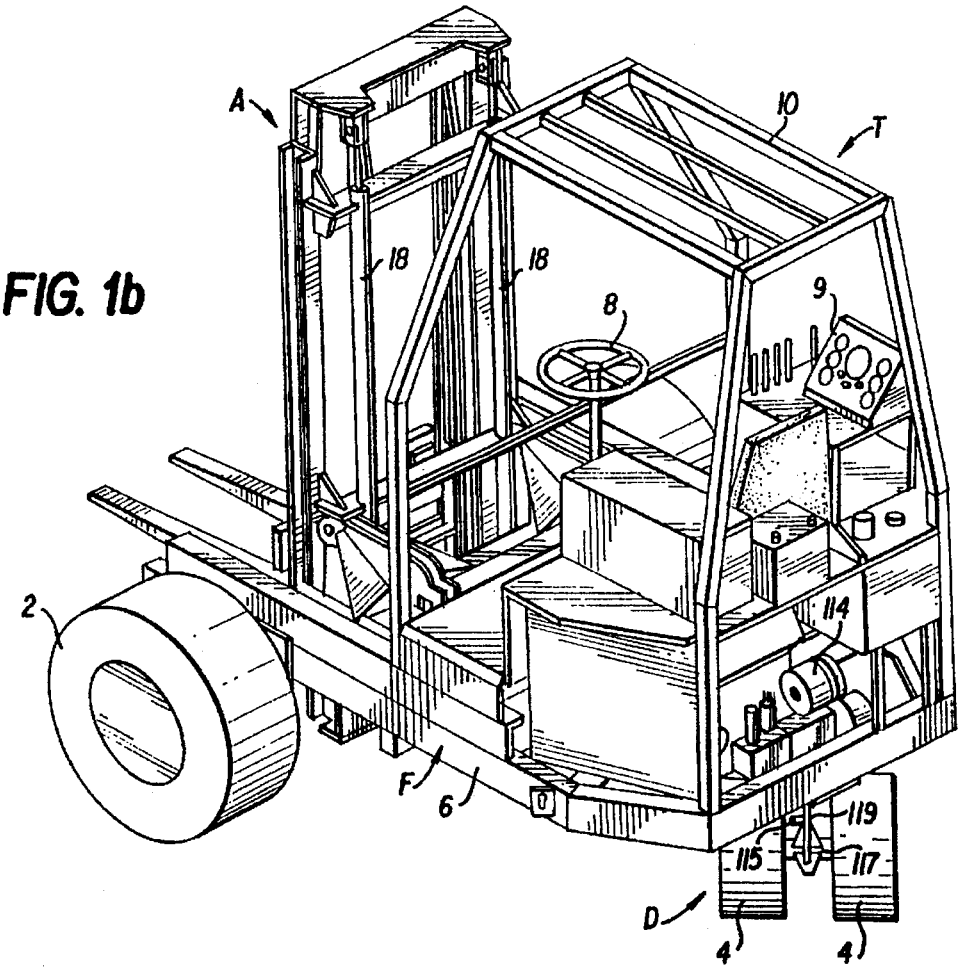
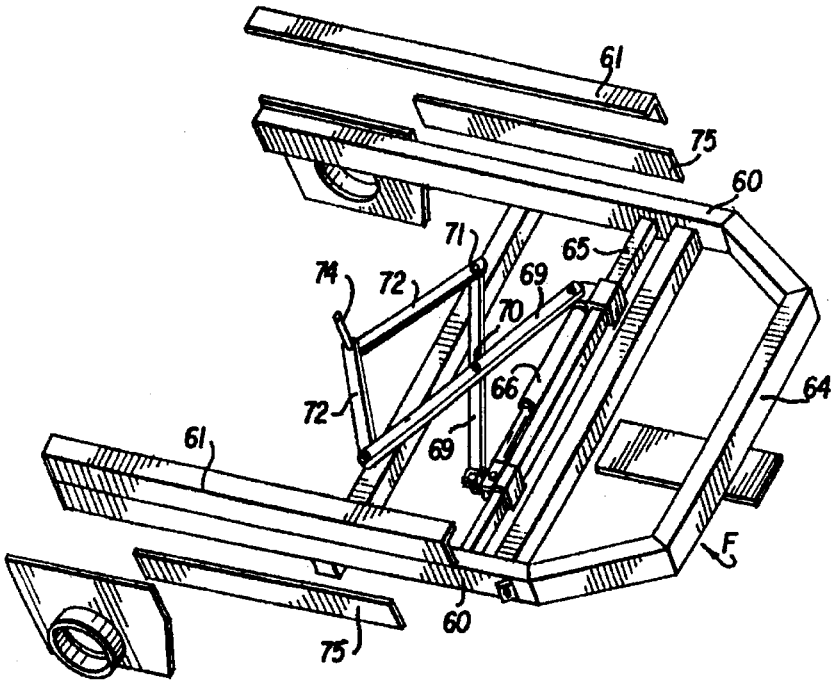
FIG. 10

FIG. 2a
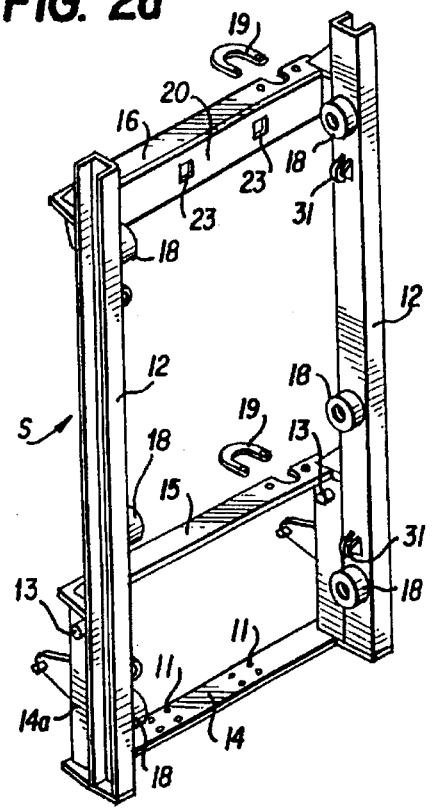
FIG. 2b
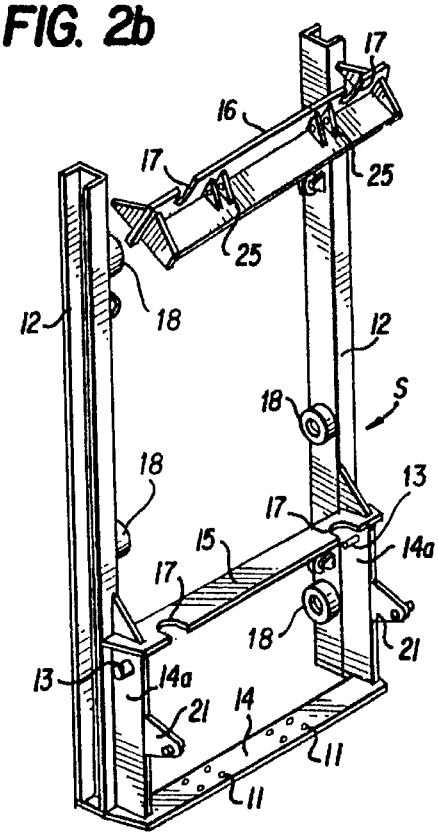
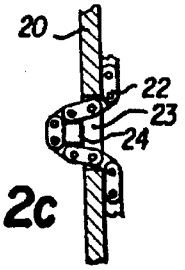
FIG. 2c
FIG. 11d
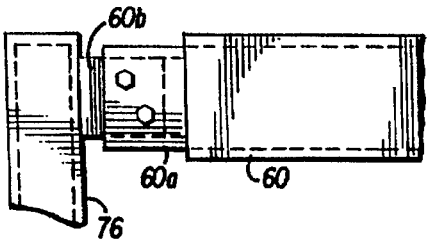
FIG. 11a
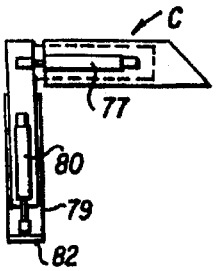
FIG. 11b
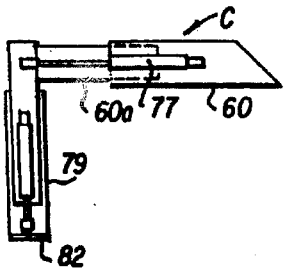
FIG. 11c
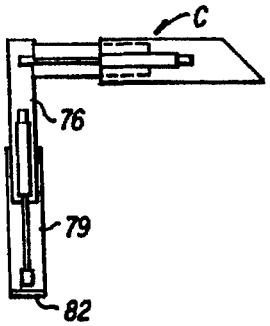

FIG. 5a
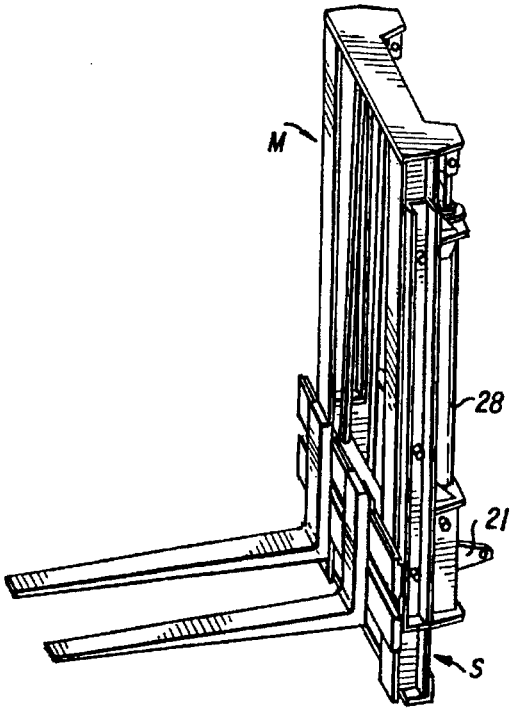
FIG. 5b
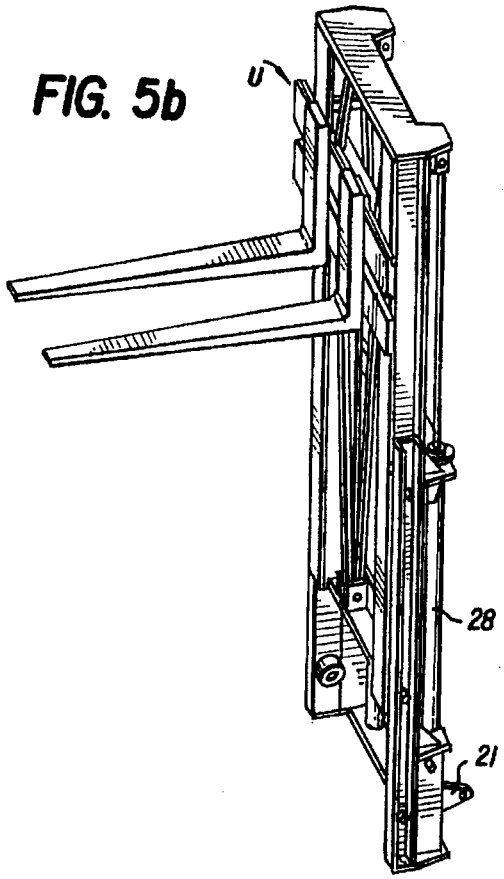
FIG. 7a
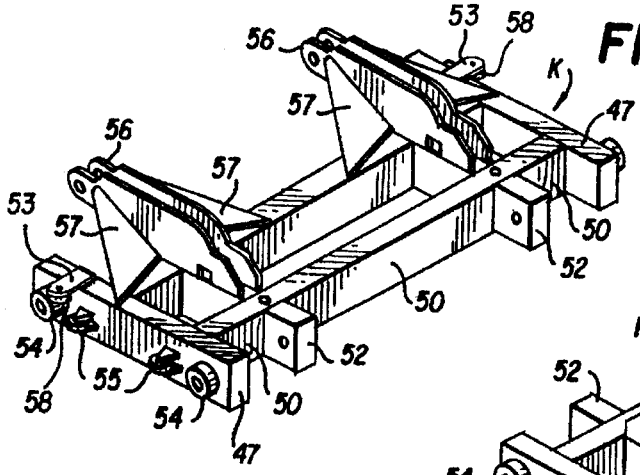
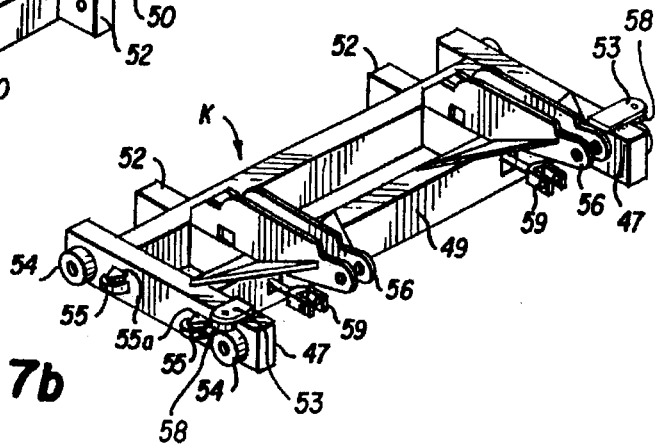
FIG. 7b

FORK LIFT TRUCK

RELATED U.S. APPLICATIONS

This Application is a continuation-in-part of application Ser. No. 08/137,345 filed Oct. 18, 1993, now U.S. Pat. No. 5,480,275.

FIELD OF THE INVENTION

The present invention relates generally to the field of fork lift trucks. More particularly, it relates to a transportable fork lift truck which is relatively light in weight, capable of handling heavy loads, and has outriggers that are variably positioned which provide stability over uneven terrain or obstructed work-sites.

BACKGROUND OF THE INVENTION

Fork lift trucks provide a useful and efficient means of transporting heavy or cumbersome cargo throughout a work-site, such as a construction work site. Fork lift trucks also provide an efficient and graceful means for stowing freight in, say, a warehouse.

Historically, fork lift trucks have usually been quite heavy so as to counterbalance the load carried by the forks. Consequentially, fork lift trucks were difficult to transport on trucks or be propelled over unpaved or soft ground.

U.S. Pat. No. 4,365,921 issued to Brouwer et al. on Dec. 28, 1982, provides an example of a lightweight fork lift truck. The fork-lift tower is mounted on a carriage which rides on a rack within the frame of the fork-lift truck via a drive shaft with gears at its ends which engage the teeth of the rack. The shaft is propelled by means of a drive chain, linked to a sprocket coupled to one side of the shaft and driven by a hydraulic motor attached to the carriage. The racks, gears, sprocket and drive chain are enclosed within the side frame members, which are hollow, to protect them from the environment.

This design eliminates the need to counter-weight the load while transporting it by providing for the fork-tower to be retracted to a point behind the front wheels, providing a reduced moment arm between the load and the fork lift truck's center-of-gravity which prevents forward tilt of the truck while transporting heavy loads.

However, the fork lift truck disclosed in this patent has various disadvantages. For example, the weight of the hydraulic motor on the carriage provides an undesirable increase of the moment force when the carriage is fully extended and holding a load. Also, the complex design of the carriage movement means is detrimental to easy operation and maintenance; by applying the torque to one end of the drive shaft and allowing the other end merely to follow, the drive shaft is capable of skewing and binding while operating, especially when grime or other contamination is present and/or wear of the two side's gears and racks are uneven or when the load on the forks is placed to one side. In addition, maintenance problems inherent with the use of drive chains are well-known and they should be avoided when possible. Further, enclosing the racks, gears, sprocket and drive chain, although necessary to protect these parts from the environment, promotes the difficulty of maintaining these high-maintenance parts. Still further, the fork lift truck disclosed in the Brouwer et al. patent lacks stability under certain operating conditions due to the design of its outrigger system.

There is a need for a lightweight fork lift truck that can stably lift and carry heavy loads, is compact and easily transportable while, at the same time, provides simple operation and maintenance.

SUMMARY OF THE INVENTION

The present invention provides a unique and clever design for a fork lift truck that has an extremely low ratio of weight to carrying capacity, is very stable, can lift and carry loads without forward pitching, provides safe and steady cargo handling on rough terrain or at obstructed work sites, and is simple to operate and maintain.

The invention includes a "lazy tong" configured fork-tower carnage horizontal movement system wherein the forks can be readily moved from a position forward of the front wheels to one behind and vice versa. This configuration provides a simple and reliable means to extend and retract the fork lift tower. The "lazy tong" is connected to the lower section of the fork-tower carriage so as not to interfere with the operations of the fork-lift tower.

Because the fork lift in accordance with the invention is intended to be transportable on the aft end of a trailer and in view of applicable transportation regulations, as well as concerns for safety and the dynamic effects of a trailing load, the overall length of the fork lift truck is kept to a minimum and its center-of-gravity is kept low.

The invention further provides a new and advantageous mast arrangement. The unique design provides negative lift for positioning the forks below the ground level and positive lift for positioning them above the level of the fork lift truck. This downward force or negative lift feature is useful for raising the front wheels of the fork lift truck for servicing and it is also used advantageously to mount the fork lift truck securely on the back of a trailer for transportation purposes.

The present invention yet further incorporates an innovative outrigger design. The outriggers extend horizontally from the front end of the fork-like frame, and once positioned horizontally, extend vertically to establish a firm contact with the underlying ground surface.

Because the outriggers extend horizontally from the front of the frame of the fork lift truck, they can be positioned to reduce or negate the moment arm caused by the freight in loading or unloading operations. The horizontal positions of the outriggers are capable of being staggered which provides unusual stability in areas where obstructions to the outrigger, on one side or the other, are frequently encountered, such as, the rear wheels associated with a flat bed trailer.

The present invention provides for independent control of the outrigger's vertical extension systems. This permits flexibility in stabilizing the fork-lift truck over uneven terrain. The option is available for synchronal control of the vertical extension systems when independent control is undesirable.

This unique hydraulic system of the outriggers provides an operator with flexibility at obstructed work sites or on uneven terrain.

The fork lift truck is typically powered by a diesel or gasoline engine. The engine is mounted in the rear of the fork lift truck under the driver's seat. It is directly coupled to a variable displacement double transmission hydraulic pump with an auxiliary pump which provides hydraulic power to the wheel hub motors and the hydraulic cylinders. The fuel tank and the hydraulic oil reservoir are positioned over the hydraulic pump in the rear of the fork lift truck.

The fork lift truck is typically provided with a hydraulic steering and propulsion system. The steering wheel tilts forward, backwards, and rotates and controls the hydraulic steering and propulsion system with these movements. The hydraulic wheel hub motors are provided with power from the variable displacement hydraulic pump. The hydraulic wheel hub motors are reversing and are interfaced to the variable displacement hydraulic pump with hydraulic conduits. The wheel hub motors may turn in the forward or reverse direction, depending upon the direction that the steering wheel is pushed or pulled. For example, when the steering wheel is pushed forward, the drive wheels rotate to travel forward, thereby causing the fork lift truck to travel ahead. Similarly, when the steering wheel is pulled backwards, the fork lift truck travels astern. The farther the steering wheel is pushed forward or moved backwards, the faster the drive wheels will turn. An accelerator pedal may be provided to increase the engine speed. Also, the wheel hub motors turn the fork lift truck in response to rotation of the steering wheel. For example, when the steering wheel is rotated counter-clockwise, the left drive wheel is rotated proportionally slower, (even oppositely), to the right drive wheel and the fork lift truck turns left, (in the respective direction the steering wheel is pushed or pulled). Similarly, when the steering wheel is rotated clockwise, the fork lift truck turns right. The farther the steering wheel is rotated in either direction, the greater the proportion is between the rotation of the left and right wheels. Thus the fork lift truck is capable of turning in a very tight circle.

When the steering wheel is released the hydraulic system is automatically returned to neutral and all drive wheel motion stops, providing a safety-stop.

BRIEF DESCRIPTION OF THE DRAWINGS

A better understanding of the invention may be appreciated from the detailed description of a preferred embodiment of the invention set forth below, considered in conjunction with the accompanying drawings, in which:

FIG. 1A is an isometric view of a fork lift truck in accordance with the invention, wherein the mast assembly is in its partially extended forward position, both outriggers are in the retracted position, partially exposed is the "lazy tong" configured fork-tower carriage horizontal movement mechanism for the mast carriage;

FIG. 1B is a further isometric view of the fork lift of FIG. 1A;

FIGS. 2A and 2B are isometric views of opposite sides of the stationary frame portion of the mast;

FIG. 2C is a detailed sectional view illustrating how the roller lift chains are secured to the upper cross brace of the stationary frame portion shown in FIGS. 2A and 2B;

FIGS. 4A and 4B are isometric views of opposite sides of the vertical carriage portion of the mast which include the lifting fork;

FIGS. 5A and 5B are isometric views of the assembled mast in a lowered and in a raised position, respectively;

FIGS. 7A and 7B are isometric views of opposite sides of the horizontal fork-tower carriage;

FIG. 10 is an expanded view of the frame which illustrates the "lazy tong" shaped fork-tower carriage horizontal motion system in the retracted position;

FIGS. 11A, 11B and 11C are side elevational views that illustrate different positions of an individual outrigger;

FIG. 11D is a detailed side elevational view illustrating how the horizontal and vertical telescoping parts of each outrigger are connected;

DETAILED DESCRIPTION OF THE PREFERRED EMBODIMENT

Figure 3A:
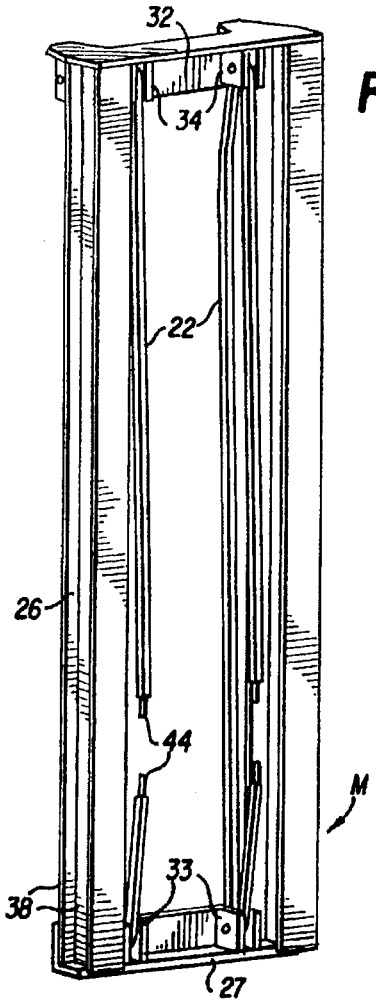
FIGS. 3A and 3B are isometric views of opposite sides of the movable frame portion of the mast.

FIGS. 1A and 1B illustrate an assembled fork lift truck, the preferred embodiment of the instant invention, designated generally as T. Fork lift truck T is designed to be light in weight, compact, and, at the same time, capable of lifting heavy loads.

Fork lift truck T is typically propelled with hydraulically actuated drive wheels 2, and includes free wheeling rear wheel 4. Hydraulic power is provided to wheel hub motors **2*a*, (shown schematically in FIG. 12), of drive wheels 2 by variable-displacement hydraulic pump 114**.

Drive wheels 2 are rotated by means of wheel hub motors **2*a*, which are attached to variable-displacement hydraulic pump 114 by hydraulic conduits via control valves controlled by steering wheel 8 through conventional control linkages. Wheel hub motors 2*a* cause drive wheels 2 to move at varying speeds in either the forward or reverse direction. For example, when steering wheel 8 is pushed forward, both of drive wheels 2 rotate to travel forward, causing fork lift truck T to travel forward. Similarly, when steering wheel 8 is pulled to the rear, fork lift truck T travels backwards. The further steering wheel 8 is moved in either direction, the faster drive wheels 2** cause fork lift T to travel in the respective direction.

When steering wheel 8 is rotated counterclockwise, while being pushed forward, right drive wheel 2 rotates to travel forward proportionally faster than left drive wheel 2, thereby causing fork lift truck T to turn to the left while moving forwardly. Similarly, when steering wheel 8 is rotated clockwise, while being pushed forward, fork lift truck T turns to the right while moving ahead. When steering wheel 8 is rotated counterclockwise, while being pulled backward, right drive wheel 2 rotates to travel astern proportionally faster than left drive wheel 2, thereby causing fork lift truck T to turn to the left while travelling rearwardly. Similarly, when steering wheel 8 is rotated clockwise, while being pulled backward, fork lift truck T turns to the right while going astern. The more steering wheel 8 is rotated in either direction, the sharper the turn of fork lift T will be in the respective direction.

Free wheeling wheels 4 are mounted on axle 117. Axle 117 is rotatably mounted to the bottom of shaft 119. The upper aspect of shaft 119 is attached to fork lift truck T and rotatable about an axis perpendicular to axle 117. Shaft 119 may be fixed in position to prevent rotation by inserting pin 115. This secured position is typically used when fork lift truck T is transported.

Front and rear wheels 2 and 4 are mounted on frame F that includes two parallel horizontally extending leg members 60. Also included in truck T are driver's seat 7, control panel 9 for the various control components of fork lift truck T hereinafter described, protective cage 10, outriggers C, lazy tong extension mechanism B, horizontal carriage K and mast assembly A.

Figure 3B:
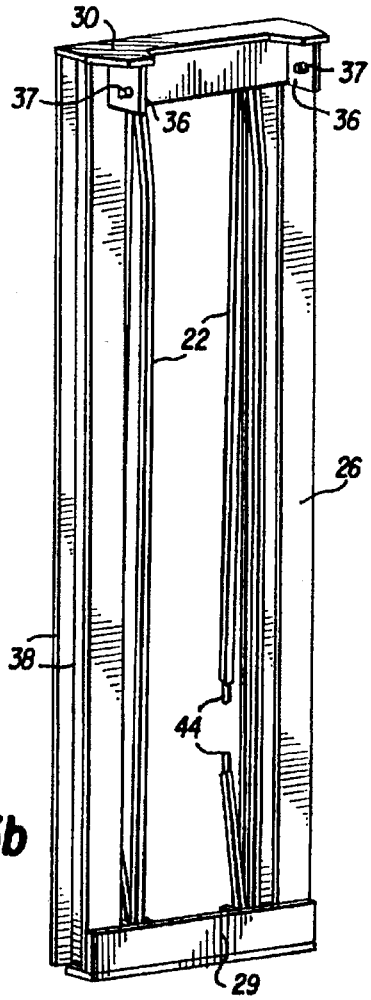

Mast assembly A includes:

(1) stationary frame S (FIGS. 2A, 2B and 2C);

(2) movable frame M (FIGS. 3A and 3B);

(3) vertical carriage U (FIGS. 4A and 4B).

Referring to FIGS. 2A and 2B, stationary frame S is generally constructed with two main channel beams 12 secured together in a parallel relationship with three permanently attached horizontal cross supports comprising lower horizontal cross brace 14, middle horizontal cross brace 15, and upper horizontal cross brace 16. Stationary frame S typically includes three main rollers 18 on the inside face of each of two channel beams 12.

Lower horizontal cross brace 14 is cantilevered from and across the bottoms of main channel beams 12, and includes threaded holes 11 to which hydraulic mast piston/cylinder combinations 28 are attached.

Middle horizontal cross brace 15 is cantilevered from main channel beams 12 above lower horizontal cross brace 14 and is further supported to beams 12 from above by triangular brackets.

A vertical plate **14*a* is affixed to each main channel beam 12. The lower end of vertical plate 14*a* is affixed to lower horizontal cross brace 14 and its upper end is affixed to middle horizontal cross brace 15. Each vertical plate 14*a* further connects and supports lower horizontal cross brace 14 and middle horizontal cross brace 15**.

A carriage pin 13 is inserted through each of vertical plates **14*a* so as to extend outwardly from each side thereof. Carriage pins 13** attached mast M to horizontal carriage K, as will be discussed hereinafter.

Ear 21 is attached to each of lower vertical plates **14*a*. Ears 21 are used to connect to hydraulic cylinders 59** that are attached to horizontal carriage K.

Upper horizontal cross brace 16 joins main channel beams 12 proximate, but slightly below, their upper ends and is further supported to beams 12 by triangular brackets above and below it.

Middle and upper horizontal cross braces 15 and 16 each includes two slots 17 which are aligned vertically and in which the cylinders of the two hydraulic mast piston/cylinder combinations 28 are received. The cylinders of hydraulic mast piston/cylinder combinations 28 are firmly secured within each of slots 17 in middle and upper horizontal cross braces 15 by clamps 19.

Upper vertically disposed horizontally extending cross brace 20 is permanently attached to the lower side of upper horizontal cross brace 16 and channel beams 12. Cross brace 20 includes two square openings 23.

FIG. 2C illustrates in detail how each of two roller lift chains 22 is received, respectively, through each of two square openings 23. Each roller lift chain 22 is removably secured therein to upper vertical cross brace 20 by means of separate pin 24 having a square or rectangular cross section. Pins 24 are inserted behind respective roller lift chains 22, and through gussets 25 which are firmly attached at the inner comer defined by the junction of upper horizontal cross brace 16 and upper vertical cross brace 20. Chains 22 are, thus, anchored therein to upper vertical cross brace 20.

Movable frame M, seen in FIGS. 3A and 3B, is generally constructed of two wide flange beams 26 that are secured in a parallel relationship by rigidly attached cross braces 27, 29, 30 and 32.

Cross brace 27 is rigidly connected across the bottoms of wide flange beams 26, extending to the ends of the outboard flanges. Lower vertically disposed cross brace 29 is rigidly connected to the top surface of cross brace 27 and across the lower portions of wide flange beams 26.

Upper cross brace 30 is permanently attached to, (also extending to the ends of the outboard flanges), and cantilevered from the top of wide flange beams 26. Upper vertical cross brace 32 is permanently attached to the lower surface of upper cross brace 30 and across the upper portions of wide flange beams 26.

Roller bracket pair 33 is attached at the inside intersection between lower cross brace 27 and lower vertical cross brace 29. Roller bracket pair 34 is attached at the inside intersection between upper cross brace 30 and upper vertical cross brace 32.

Lift chain sprockets (not shown) are rotatably received in bracket pairs 33 and 34 and serve as carriers for roller lift chains 22 (shown diagrammatically) that rotate on the sprockets within each of roller bracket pairs 33 and 34.

Two mount tabs 36 extend rigidly from both upper cross brace 30 and upper vertical cross brace 32. The top end of the piston rod of each of hydraulic mast piston/cylinder combination 28 attaches to pin 37 which is received through corresponding mount tab 36.

Wear plates 38 removably line both the inboard and outboard inner surfaces of the flanges and the both the inboard and outboard surfaces of the webs of wide flange beams 26, and provide a replaceable bearing surface for main rollers 42 and guide rollers 45 of vertical carriage U as well as for main rollers 18 and guide rollers 31 of stationary frame S. Relationship between movable frame M, vertical carriage U, and stationary flame S, will be discussed subsequently.

Referring to FIGS. 4A and 4B, vertical carriage U is generally constructed of two vertical members 35 to which upper tine support 39 and lower fine support 40 are rigidly attached.

Two main rollers 42 are rotatably mounted on the outboard faces of vertical members 35, being journalled on shafts that extend outwardly from each face thereof.

Guide roller 45 is rotatably mounted on the outboard face of each of vertical members 35 by means of a shaft connecting and perpendicular to parallel brackets **45*a*. Parallel brackets 45*a* are connected normally from vertical members 35**.

Lifting forks or tines 46 are adjustably secured to upper tine supports 39 and lower tine supports 40 and extend horizontally outwardly therefrom.

Lifting forks 46 are described herein and in the FIGURES. by way of example only; other useful tools, known to those skilled in the art, are capable of being secured to vertical carriage U, such as: concrete forks, barrel clamps, hydraulic hole diggers, scoops and side-shifters.

Referring now to FIGS. 1A through 6B, stationary frame S, movable frame M, and vertical carriage U, cooperate to provide mast assembly A with means for positive lift and negative lift.

Vertical carriage U is slidably connected to movable frame M and disposed between wide flange beams 26 and vertical cross braces 33 and 32. Main rollers 42 and guide rollers 45 of vertical carriage U travel vertically along the length of the inboard faces of the webs of wide flange beams 26. Main rollers 42 are spaced from the inboard wear plates 38 of the webs of wide flange beams 26 and provide rotational bearing contact to the wear plates 38 of the inside flanges of beams 26. Guide rollers 45 provide rotational contact with the inside face of the webs of beams 26 and center carriage U therebetween.

Each end of roller lift chain 22 has a threaded bolt 44 that connects to the upper and lower aspects of vertical carriage U.

Movable frame M is slidably connected to stationary frame S and disposed between channel beams 12. Beam rollers 18 and guide rollers 31 are disposed between the outboard flanges of wide flange beams 26 and between the stops formed by lower cross brace 27 and upper cross brace 30 protruding to the ends of the outboard flanges at the ends of beams 26. Beam rollers 18 are spaced from outboard wear plate 38 of the webs of beams 26 and provide rotational bearing contact to wear plate 38 of the outboard flanges of beams 26. Guide rollers 31 center frame M between channel beams 12 and provide a roller bearing contact to the outboard wear plate 38 of the webs of beams 26.

As discussed above, parallel portions of lift chain 22 are anchored in cross brace 20 of stationary frame S with pins 24. Each roller lift chain 22 is rotatably engaged by the rotatable sprockets between sprocket brackets 33 and 34, located at opposite ends of movable frame M. Each end of roller lift chain 22 has threaded bolt 44 that connects to the upper and lower aspects of vertical carriage U. Therefore, each chain 22 is, essentially, a continuous loop which is anchored at one point to frame S, is in rolling contact at two points with frame M and has each end connected together via carriage U.

Preferably, chain 22 is composed of flat links whose sides are formed of plates of wrought iron or steel, riveted together, the centers of the links coinciding in distance apart with the centers of the projections upon the lift chain sprocket wheels, but the projections themselves fall into clear interspaces midway between the centers of the pins which unite the links.

The cylinders of hydraulic mast piston/cylinder combinations 28 are attached at their lower ends to threaded holes 11 through lower horizontal cross brace 14 of stationary frame S. The upper ends of hydraulic mast piston/cylinder combinations 28, each upper end comprising the end of the piston rod of hydraulic mast piston/cylinder combination 28, are attached to pins 37 mounted to extend normally from mount tabs 36, as previously described.

Hydraulic mast piston/cylinder combination 28 is a double acting piston/cylinder column combination whereby when hydraulic pressure is applied below the internal piston of hydraulic mast piston/cylinder combination 28, the piston, piston rod and thence, movable frame M are forced upwards to lift a load carried by tines 46. When hydraulic pressure is applied above the internal piston of hydraulic mast piston/cylinder combination 28, the piston, piston rod and thence, movable frame M are forced downwardly. Hydraulic mast piston/cylinder combinations 28 are attached to, and receive hydraulic pressure from, variable displacement hydraulic pump 114 by hydraulic conduits via control valves controlled from control panel 9.

The vertical motion of movable frame M causes roller lift chain 22, which is anchored at one point to stationary frame S, to move vertical carriage U, and thence, tines 46, a distance equal to twice the vertical distance travelled by the piston movement.

The downward travel of lifting tines 46 below ground level is of sufficient distance to raise the front end of fork lift truck T. Preferably, tines 46 vertically extend below carriage U a sufficient distance which provides that tines 46 contact ground-level before the bottom of frame M while providing that chain 22 and hydraulic mast piston/cylinder combination 28 have sufficient travel, before carriage U is stopped at the bottom of frame M, to allow tines 46 to push-up, with negative lift, fork-lift T. Usually, tines 46 need to push-up fork-lift T no more than a few inches to lift wheels 2 from the underlying ground.

Horizontal carriage K is depicted in FIGS. 7A through 8B, the general construction of horizontal carriage K being illustrated in FIGS. 7A and 7B. Horizontal carriage K supports mast assembly A on fork lift truck T. It comprises main longitudinal tubes 47 which are permanently connected in a parallel relationship by front cross tube 49, and a set of three rear cross tubes 50 that extend across the spaces defined between the insides of tubes 47 and interior longitudinal tubes 52.

Rotatably mounted on each of the two outboard faces of main longitudinal tubes 47 are two main rollers 54. Main rollers 54 are rotatably mounted on main longitudinal tubes 47 via roller shafts which are normally received through the outboard sides of main longitudinal tubes 47.

Two guide rollers 55 are rotatably mounted between brackets 55*a* extending normally from each of the outboard faces of main longitudinal tubes 47. The axis of rotation provides that guide rollers 55 roll on a plane parallel to the outboard side longitudinal plane of tubes 47.

A bracket 53, (FIG. 9A), is attached across the top of each main longitudinal tube 47 and cantilevered outwardly therefrom. Rotatably attached and depending from the bottom outboard end-section of bracket 53, via a roller shaft, is stabilizer roller 58. The axis of rotation of stabilizer roller 58 is normal to bracket 53.

Two pairs of mast mount brackets 56 are securely attached to the tops of interior longitudinal tubes 52. These mast mount brackets 56 are stiffened and reinforced by wing plates 57 disposed to extend from each side of mast mount brackets 56 and rigidly connected inboard to tube 49 and outboard to tubes 47. Mast assembly A is supported by horizontal carriage K by means of carriage pins 13 that are received through aligned openings provided in mast mount brackets 56.

The cylinders of tilt hydraulic cylinder/piston combinations 59 are attached with pins to the interior rear sections of each of longitudinal tubes 52. Each end of the piston rods of tilt hydraulic cylinder/piston combinations 59 are connected to the respective ear 21 of stationary frame S. The entire mast assembly A may be tilted forwardly and rearwardly by applying hydraulic pressure to tilt hydraulic cylinder/piston combination 59, as will be appreciated from FIGS. 6A and 6B. Preferably, mast assembly A may be tilted eight degrees in either direction from the vertical plane, (perpendicular to the horizontal plane of fork lift truck T).

Tilt hydraulic cylinder/piston combinations 59 is a double acting piston/cylinder column combination whereby when hydraulic pressure is applied below the internal piston of tilt hydraulic cylinder/piston combinations 59, the piston, piston rod and thence, mast assembly A are tilted forwardly, pivoting on pin 13. When hydraulic pressure is applied above the internal piston of tilt hydraulic cylinder/piston combinations 59, the piston, piston rod and thence, mast assembly A are tilted rearwardly, again pivoting on pin 13. Tilt hydraulic cylinder/piston combinations 59 are attached to, and receive hydraulic pressure from, variable-displacement hydraulic pump 114 by hydraulic conduits via control valves controlled from control panel 9.

Figure 9A:
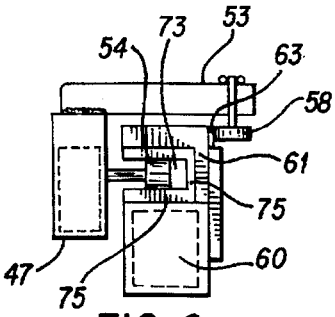
FIG. 9A is an end view of the main horizontal frame and connected angle iron pieces with a wear-plate carried between them and a section of the horizontal fork-tower carriage deployed therein.
Figure 9B:
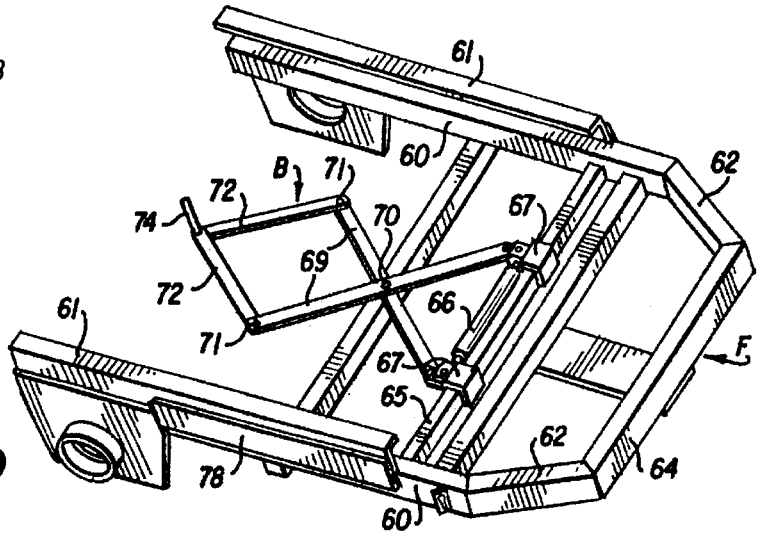
FIG. 9B is an isometric view of the main frame which illustrates the "lazy tong" shaped fork-tower carriage horizontal motion arrangement in extended position.
Figure 6A:
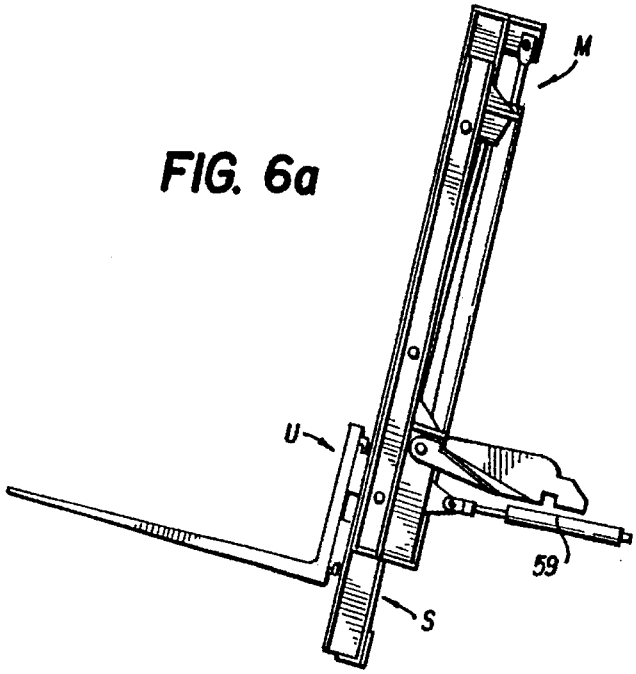
FIGS. 6A and 6B are side elevational views that illustrate the mast arranged for tilting rearwardly and forwardly, respectively.
Figure 6B:
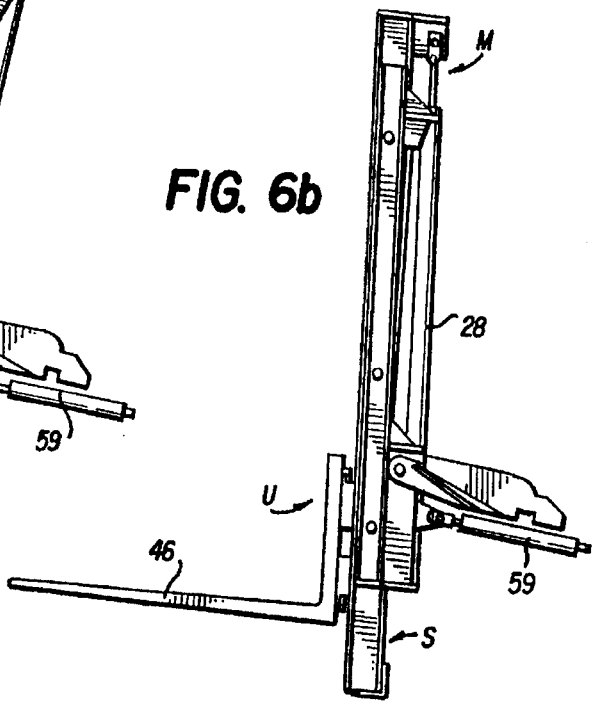
Figure 8A:
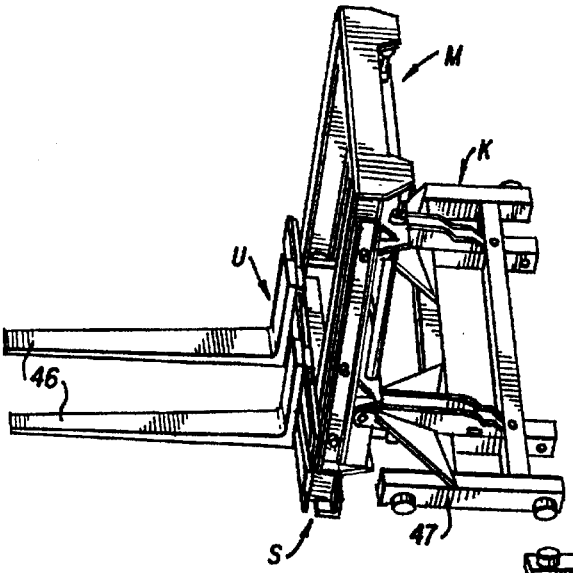
FIGS. 8A and 8B are isometric views illustrating the upper and lower arrangements, respectively, of the mast assembly with the horizontal fork-tower carriage attached thereto.
Figure 8B:
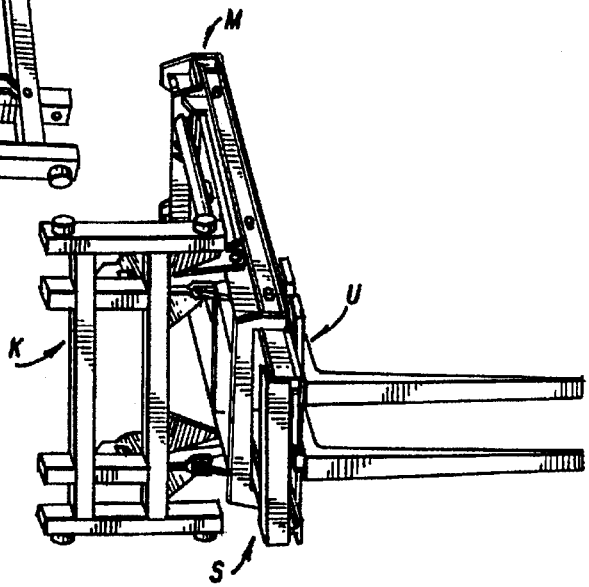

Main frame F of truck T, illustrated in FIG. 9B, is generally constructed of tubing having a rectangular cross-section and includes two main horizontal parallel frames 60 permanently attached to two diagonal main frame members 62 that are rigidly joined by rear frame cross support 64. Other supports may be provided, as would be obvious to one skilled in the art, further to support main frame F.

Supported from the lower forward section of each frame 60 is hydraulically actuated drive wheel 2 and its corresponding wheel hub motor 2*a*. Shaft 119 is rotatably attached to the middle of frame 64. Main frame F supports all the components of fork lift truck T, either directly or indirectly and generally defines the lowermost section of forklift truck T.

Attached along the length of each of main horizontal frame 60 are angle iron pieces 61 having L-shaped cross sections. Reinforcement plates 78 provide a reinforcing interface between main horizontal frame 60 and angle iron pieces 61.

"Lazy tong" horizontal motion system B is provided in the main frame as illustrated in FIGS. 9B and 10. The lazy tong of hydraulically actuated "lazy tong" horizontal motion system B is extended or retracted by means of double-acting hydraulic piston/cylinder set 66.

Tubular bar 65 is attached at each end to the inside walls of main horizontal frame 60. Hydraulic piston/cylinder set 66 has attached thereto at each end babbitt metal lined tubes 67. Babbitt metal lined tubes 67 are slidably received by tubular bar 65 so that as hydraulic piston/cylinder set 66 is extended or retracted, babbitt metal lined tubes 67 slide along the outer surfaces of tubular bar 65. Each babbitt lined tube 67 is attached to scissor-like handle 69 of "lazy tong" extension mechanism B. Scissor bars 69 are typically flat and cross at their centers at which point they are slidably connected with pin 70 to be rotatable through a portion of an arc about pin 70. Each of the ends of scissor bars 69 opposite their connection to set 66 are rotatably connected by pins 71 to extension bars 72. Extension bars 72 are rotatably joined at their ends opposite scissor bars 69 with shaft 74 which extends upwardly from its connection to both extension bars 72. Shaft 74 is attached to the mid-section of middle rear cross tube 50 of horizontal carriage K.

Hydraulic piston/cylinder set 66 is a double acting piston/cylinder column combination whereby when hydraulic pressure is applied below the internal piston of hydraulic piston/cylinder set 66, hydraulic piston/cylinder set 66 is caused to lengthen, thus retracting the lazy tongs of "lazy tong" extension mechanism B, horizontal carriage K, and mast assembly A. When hydraulic pressure is applied above the internal piston of hydraulic piston/cylinder set 66, hydraulic piston/cylinder set 66 contracts, thus extending the lazy tongs of "lazy tong" extension mechanism B, horizontal carriage K, and mast assembly A. Hydraulic piston/cylinder set 66 is attached to, and receives hydraulic pressure from, variable-displacement hydraulic pump 114 by hydraulic conduits via control valves controlled from control panel 9.

"Lazy tong" extension mechanism B is disposed in a horizontal plane between parallel horizontally extending leg members 60 providing sufficient clearance from the ground when "lazy tong" extension mechanism B is in its retracted position and contributing to a low center of gravity to fork lift truck T.

As seen in FIG. 9A, the interior sides of angle bar 61 and the top of frame 60, below angle bar 61 forms track 73. Track 73 thus formed is lined with wear plate 75 to provide a wear surface for a longer life and ease of replacement.

Guide rollers 55 center horizontal carriage K between angle bars 61 and provide a roller bearing contact to the vertical wear plate 75. As illustrated in FIG. 9A, main rollers 54 of horizontal carriage K are received to move in track 73, preferably, along lower wear plate 75. Bracket 53 is suspended over, and does not contact, the top of angle bar 61. Stabilizer roller 58 is in rotational contact with a wear plate 63. Wear plate 63 is attached to along top outboard section of the vertical section of angle bar 61 and forms a track for roller 58 to ride upon. Stabilizer roller 58 assists roller 55 in preventing horizontal carriage K from skewing and provides further support to main frame F.

In its fully extended position, "lazy tong" extension mechanism B pushes horizontal carriage K to the front end of horizontal frame 60. In its fully retracted position, "lazy tong" extension mechanism B extends substantially across the width of horizontal frame B and pulls horizontal carriage K toward the cab of fork lift truck T.

Individual outrigger C is illustrated in FIGS. 11A, 11B, 11C and 11D. There are two outriggers C, one being attached to each of main horizontal frame 60 of the main frame.

Outriggers C are generally constructed of tubular steel. Horizontal tube 60*a* is slideably received in a telescoping fashion in each main horizontal frame 60. Short tube 60*b* is inserted into the outer end of horizontal tube 60*a* and permanently affixed thereto. Short tube member 60*b* is coupled at a right angle to fixed vertical tube 76. Horizontal double-acting hydraulic piston/cylinder sets 77 are disposed within each horizontal frame leg 60 and horizontal tube 60*a* and are connected at one end by means of a pin to the interior wall of main horizontal frame 60 and at the other end by means of a further pin to fixed vertical tube 76. By appropriate actuation of the horizontal hydraulic piston/cylinder set 77, tube 60*a* extends from or retract into tube 60 to provide selected positioning of each outrigger C in a horizontal direction. Preferably, outriggers C horizontally extend fixed vertical tube 76 to a vertical plane, or beyond a vertical plane, containing the tips of fully extended tines 46, (thus providing support directly below or beyond the outermost point of the center-of-gravity of a supportable load).

Hydraulic piston/cylinder sets 77 are double acting piston/cylinder column combinations whereby when hydraulic pressure is applied below the internal pistons of hydraulic piston/cylinder sets 77, hydraulic piston/cylinder sets 77 are caused to lengthen, thus extending tubes 60*a*. When hydraulic pressure is applied above the internal pistons of hydraulic piston/cylinder sets 77, hydraulic piston/cylinder sets 77 contracts, thus retracting tubes 60*a*. Hydraulic piston/cylinder sets 77 are attached to, and receive hydraulic pressure from, variable-displacement hydraulic pump 114 by hydraulic conduits via control valves controlled from control panel 9.

Fixed vertical tube 76 is slidably and telescopically received in movable vertical tube 79 which has ground engaging pad 82 mounted at its lowermost end. Vertical hydraulic piston/cylinder set 80 is disposed within fixed vertical tube 76 and movable vertical tube 79 and is connected at one end by a pin to the inner wall of fixed vertical tube 76 and at its other end by a pin to movable vertical tube 79.

Hydraulic piston/cylinder sets 79 are double acting piston/cylinder column combinations whereby when hydraulic pressure is applied below the internal piston of either hydraulic piston/cylinder set 79, the respective hydraulic piston/cylinder sets 79 is caused to lengthen, thus extending, the respective ground engaging pad 82. When hydraulic pressure is applied above the internal piston of either hydraulic piston/cylinder set 79, the respective hydraulic piston/cylinder set 79 6contracts, thus retracting, the respective ground engaging pad 82. Hydraulic piston/cylinder sets 79 are attached to, and receive hydraulic pressure from, variable-displacement hydraulic pump 114 by hydraulic conduits via control valves controlled from control panel 9.

Figure 12:
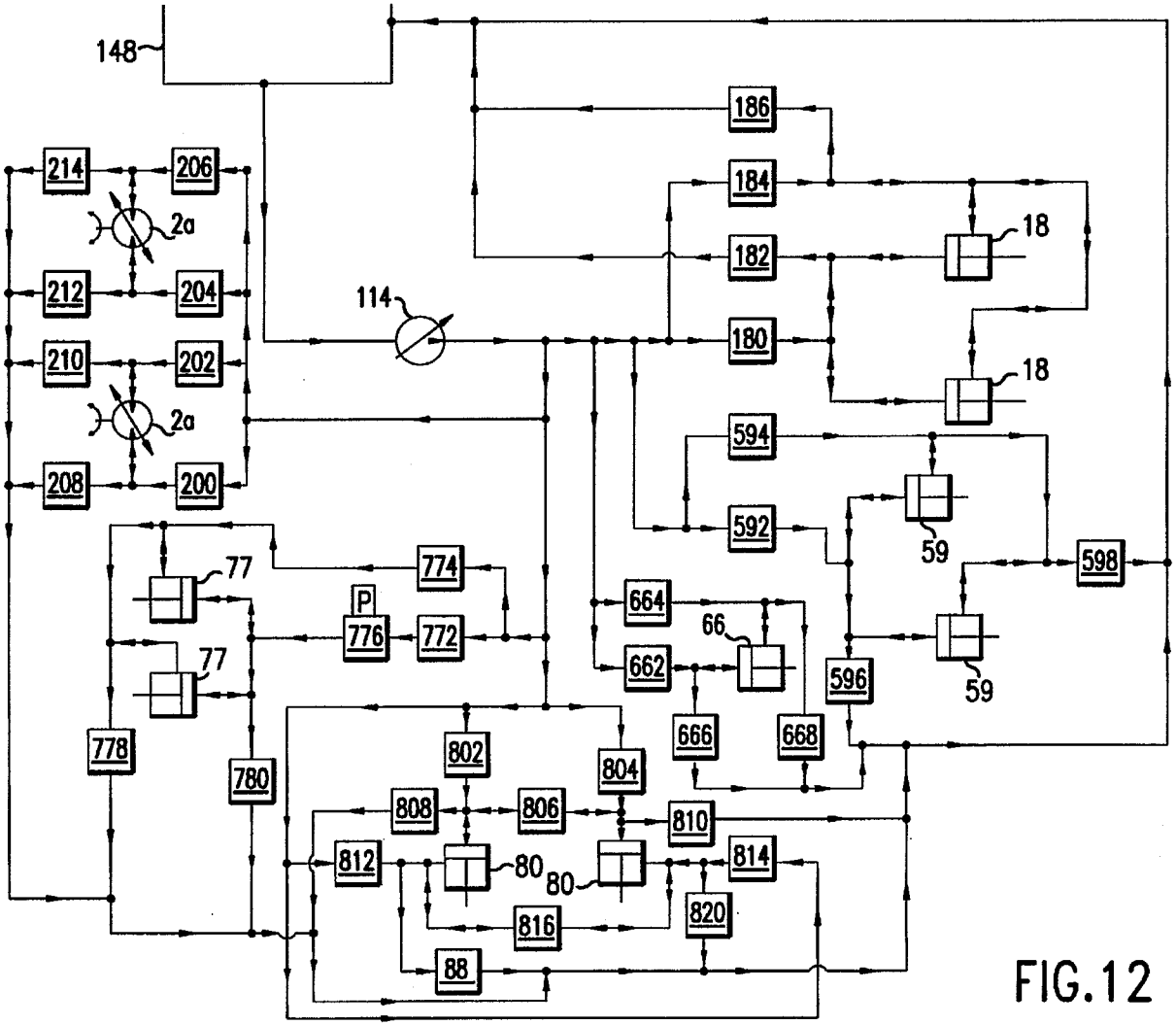
FIG. 12 is a schematic drawing of the hydraulic system of the present invention.

FIG. 12 is a schematic diagram illustrating an example of the hydraulic operation of the present invention. Square symbols broadly represent valve components whereby, by actuation through control panel 9, hydraulic flow (represented by arrowed lines) either is fully allowed, throttled or stopped thereat. Many of the valve components are controlled to be synchronous with other valve components, either directly or inversely, as will be described hereinafter. The valve components are connected and controlled by the controls on control panel 9 via conventional control linkages.

Variable displacement pump 114 broadly represents the hydraulic pressure source for all the hydraulic components of fork lift T and may, for example, be a single variable displacement pump powerful enough to provide full hydraulic power to all the hydraulic components simultaneously, a bank of hydraulic pumps capable of doing the same, a multitude of variable displacement pumps supplying each components system independently, or combinations thereof.

An illustrative example of the general operation of the hydraulic system of fork lift truck T is described hereinafter.

When the operator of fork lift truck T manipulates the controls on control panel 9 to raise forks 46, valve component 180 is actuated to permit hydraulic fluid to flow therethrough whereby to put pressure is applied to the underside of the pistons of piston/cylinder sets 28. Simultaneously, valve component 186 is actuated to permit hydraulic fluid to flow therethrough to relieve pressure on the upper side of the pistons of piston/cylinder sets 28, thus, causing piston/cylinder sets 28 to extend and raising forks 46 as described hereinbefore. To lower forks 46, the operator manipulates the controls on control panel 9 to cause hydraulic fluid to flow through valve components 184 and 182, pressurizing the upper sides of the pistons of piston/cylinder sets 28 and depressurizing the lower sides of the pistons of piston/cylinder sets 28, respectively. Thus, piston/cylinder sets 28 retract, lowering forks 46, as described above.

To tilt the upper aspect of mast assembly A rearwardly, the operator of fork lift truck T manipulates the controls on control panel 9 to cause hydraulic fluid to flow through valve components 592 and 598, thus applying pressure the lower sides and depressurizing the upper sides, respectively, of the pistons of piston/cylinder sets 59, thus tilting the lower aspect of mast assembly A forwardly, as heretofore described. To tilt the upper aspect of mast assembly A forwardly, the operator of fork lift truck T manipulates the controls on control panel 9 to cause hydraulic fluid to flow through valve components 594 and 596 to depressurize the lower side of and pressurize the upper side, respectively, of the pistons of piston/cylinder sets 59, thus tilting the lower aspect of mast assembly A rearwardly.

To extend lazy tong horizontal motion mechanism B, the operator of fork lift truck T manipulates the controls on control panel 9 to cause hydraulic fluid to flow through valve components 664 and 666 pressurizing and depressurizing, respectively, the lower and upper sides of the piston of piston/cylinder set 66, thus extending lazy tong horizontal motion mechanism B, as described hereinbefore. To retract lazy tong mechanism B, the operator of fork lift truck T manipulates the controls on control panel 9 to permit hydraulic fluid to flow through valve components 662 and 668 which pressurizes and depressurizes, respectively, the upper and lower sides of the piston of piston/cylinder set 66.

Drive wheels 2 are rotated by wheel hub motors 2*a*, which are attached to variable-displacement hydraulic pump 114 by hydraulic conduits via control valves components 200, 202, 204, 206, 208, 210, 212, and 214. These control valve components are controlled by and connected to steering wheel 8 through conventional control linkages. Wheel hub motors 2*a* are, preferably, rotary motors with variable displacements that rotate in either direction. Valve components 200, 202, 204, 206, 208, 210, 212, and 214 either block hydraulic fluid flow to wheel hub motors 2*a* or cause a throttled or full flow, as desired, to wheel hub motors 2*a* in response to movement of steering wheel 8.

To propel fork lift T forwardly, steering wheel 8 is pushed forward which causes valve components 200, 210, 204 and 214 to open in proportion to the how far steering wheel 8 is moved forwardly. The more steering wheel 8 is moved forward, the more these valve components permit hydraulic fluid to flow through wheel hub motors 2*a*, thus increasingly propelling fork lift T forwardly. When steering wheel 8 is pushed to its forward limit, these valve components allow a full hydraulic fluid flow through wheel hub motors 2*a*, causing fork lift truck T to move forward as rapidly as circumstances allow.

To turn fork lift T left, while it is proceeding forwardly, steering wheel 8 is turned counter-clockwise, (while steering wheel 8 is pushed forward). This causes valve components 200 and 210 to throttle down the flow of hydraulic fluid through the port wheel hub motor 2*a* in proportion to how far steering wheel 8 is turned counter-clockwise. Thus, with port drive wheel 2 rotating slower than starboard drive wheel 2, fork lift truck T turns left. The more steering wheel 8 is turned counter-clockwise the more these valve components throttle down the hydraulic flow through port wheel hub motor 2*a*. If valve components 200 and 210 cannot throttle down the flow further, i.e.- because they are fully blocking the flow, and steering wheel 8 is turned counter-clockwise farther, valve components 202 and 208 throttle open, forcing port wheel hub motor 2*a* to turn port drive wheel 2 in reverse. The more steering wheel 8 is mined thereafter, the more these valve components throttle open forcing port wheel hub motor 2*a* to turn port drive wheel 2 in reverse. Thus, the front of fork lift truck T can turn with a very tight radius to the left.

To turn fork lift T right, while it is proceeding forwardly, steering wheel 8 is tamed clockwise, (while steering wheel 8 is pushed forward). This causes valve components 204 and 214 to throttle down the flow of hydraulic fluid through the starboard wheel hub motor 2*a* in proportion to the amount steering wheel 8 is turned clockwise. Thus, with starboard drive wheel 2 rotating slower than port drive wheel 2, fork lift truck T turns right. The more steering wheel 8 is turned clockwise the more these valve components throttle down the hydraulic fluid flow through starboard wheel hub motor 2*a*. If valve components 204 and 214 can no longer throttle the flow of the hydraulic fluid, i.e.- because they are fully blocking its flow, and steering wheel 8 is turned clockwise farther, valve components 206 and 212 throttle open, forcing starboard wheel hub motor 2*a* to turn starboard drive wheel 2 in reverse. The more steering wheel 8 is turned thereafter, the more these valve components throttle open forcing starboard wheel hub motor 2*a* to turn starboard drive wheel 2 in reverse. Thus, the front of fork lift truck T can turn with a very tight radius to the right.

To propel fork lift T to the rear, steering wheel 8 is pulled backward which causes valve components 202, 208, 206 and 212 to throttle open in proportion to how far steering wheel 8 is moved rearwardly. The more steering wheel 8 is so moved, the more these valve components cause hydraulic fluid to flow through wheel hub motors 2a to propel fork lift T rearwardly. When steering wheel 8 is pulled to its limit backwardly, these valve components cause a full flow of hydraulic fluid through wheel hub motors 2a, thus propelling fork lift truck T to the rear as fast as circumstances allow.

To turn fork lift T left, while it is proceeding backwardly, steering wheel 8 is, again, turned counter-clockwise, (while steering wheel 8 is pulled backward). This causes valve components 202 and 208 to throttle down the flow of hydraulic fluid through the port wheel hub motor 2a in proportion to how much steering wheel 8 is mined counter-clockwise. Thus, with port drive wheel 2 rotating in reverse slower than starboard drive wheel 2, fork lift truck T turns left, while going astern. The more steering wheel 8 is turned counter-clockwise the more these valve components throttle down the hydraulic fluid flow through port wheel hub motor 2a. If valve components 202 and 208 cannot throttle down this flow more, i.e.- because they are fully blocking the flow, and steering wheel 8 is turned counter-clockwise farther, valve components 200 and 210 commence to throttle open, forcing port wheel hub motor 2a to rotate port drive wheel 2 forwardly. The more steering wheel 8 is tamed thereafter, the more these valve components throttle open forcing port wheel hub motor 2a to rotate port drive wheel 2 ahead. Thus, considered from the standpoint of astern movement, fork lift truck T can turn with a very tight radius to the left.

To turn fork lift T right, while it is proceeding astern, steering wheel 8 is turned clockwise, (while steering wheel 8 is pulled backward). This causes valve components 206 and 212 to throttle down the flow of the hydraulic fluid through the starboard wheel hub motor 2a in proportion to how far steering wheel 8 is turned clockwise. Thus, with starboard drive wheel 2 rotating slower rearwardly than port drive wheel 2, fork lift truck T turns right while going astern. The more steering wheel 8 is turned clockwise the more these valve components throttle down the hydraulic fluid flow through starboard wheel hub motor 2a. If valve components 206 and 212 cannot throttle down the hydraulic fluid flow further, i.e.- because they are fully blocking that flow, and steering wheel 8 is turned farther clockwise, valve components 204 and 214 throttle open forcing starboard wheel hub motor 2a to turn starboard drive wheel 2 ahead. The more steering wheel 8 is turned thereafter, the more these valve components throttle open forcing starboard wheel hub motor 2a to turn starboard drive wheel 2 ahead. Thus, from the standpoint of fork lift truck T moving in a rearward direction, it can turn with a very tight radius to the right.

Figure 12A:
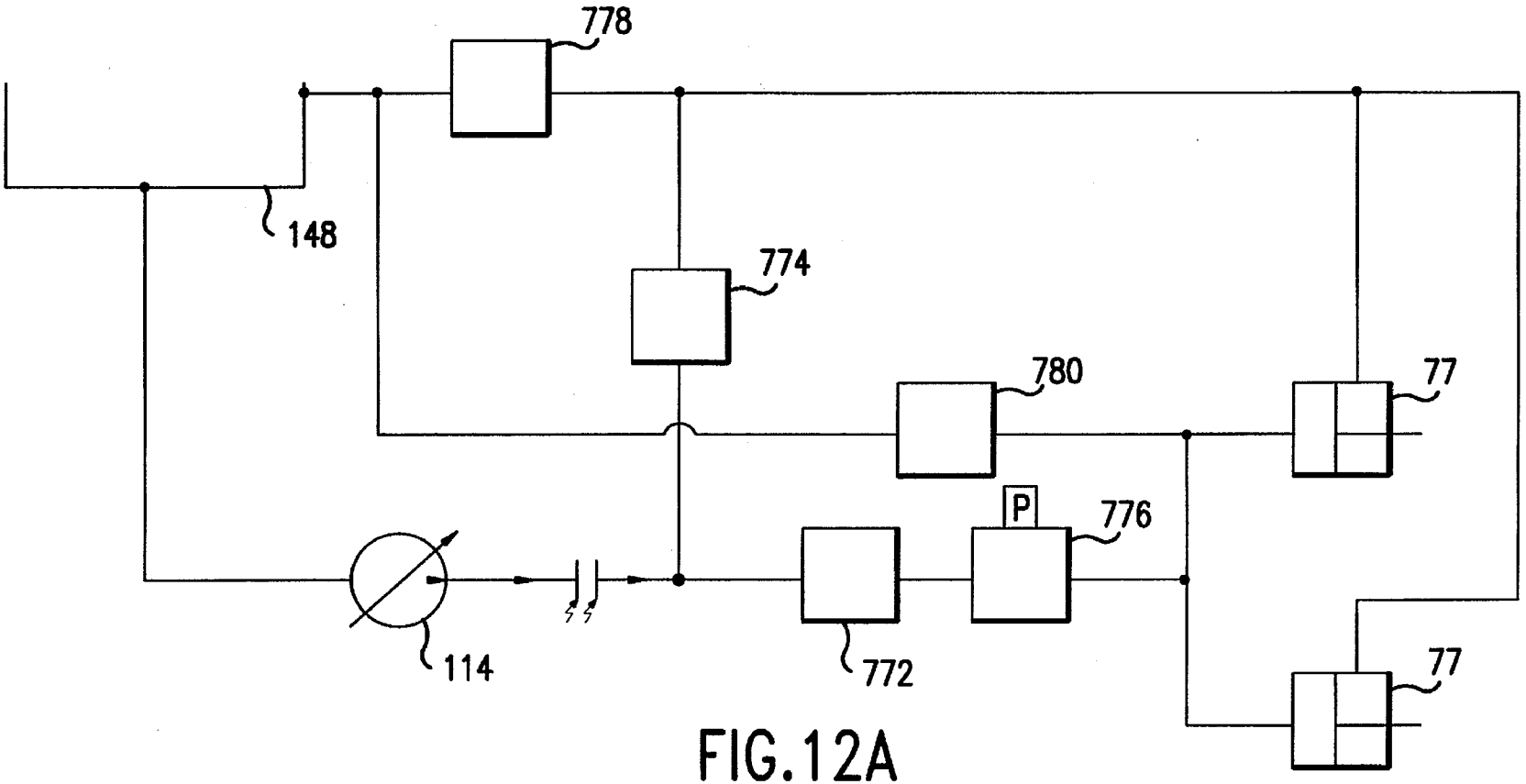
FIG. 12A is a detailed view taken from FIG. 12 showing the horizontal movement hydraulic system of the outriggers.

Referring to FIG. 12A, which is an detail view derived from FIG. 12 for an operational flow diagram of the horizontal extension system for outriggers C. To extend outriggers C horizontally, the operator of fork lift truck T manipulates the controls on control panel 9 to allow hydraulic fluid flow through valve components 772 and 778 pressurizing and depressurizing, respectively, the upper side and lower side of the piston of piston/cylinder sets 77. Because piston/cylinder set combinations both share a common supply line, when one extending outrigger C encounters a substantial obstruction, it will be essentially stopped, and the hydraulic fluid, seeking the path of least resistance, will flow fully to the unobstructed piston/cylinder set 77 until it too meets an obstruction or reaches the length of its extension. Pressure sensitive valve component 776, which broadly represents, a shutoff valve controlled by a pressure switch, a pilot operated relief valve, a pressure reducing valve, or a sequence valve, provides means to maintain hydraulic pressure to the upper sides of the pistons of piston/cylinder sets 77 to a level that is only slightly greater than the pressure required to extend outrigger C, horizontally, without obstructions. Thus, when one outrigger C is obstructed and the other is fully extended, or they are both fully extended, or they are both obstructed, pressure sensitive valve component 776 does not allow hydraulic fluid flow to the top sides of pistons of the piston/cylinder sets 77 to build-up too much pressure. Consequently, outrigger C can be horizontally staggered to make efficient use of the outrigger system in obstructed work sites. To retract outrigger C horizontally, the operator or fork lift truck T manipulates the controls on control panel 9 to cause hydraulic fluid to flow through valve components 774 and 780, pressurizing and depressurizing, respectively, the bottom and top sides of the piston of piston/cylinder sets 77. This, of course, causes pressure sensitive valve components 776 to permit hydraulic fluid to flow therethrough but, during this operation, hydraulic fluid flow is not permitted through valve components 772 and 778.

Figure 12B:
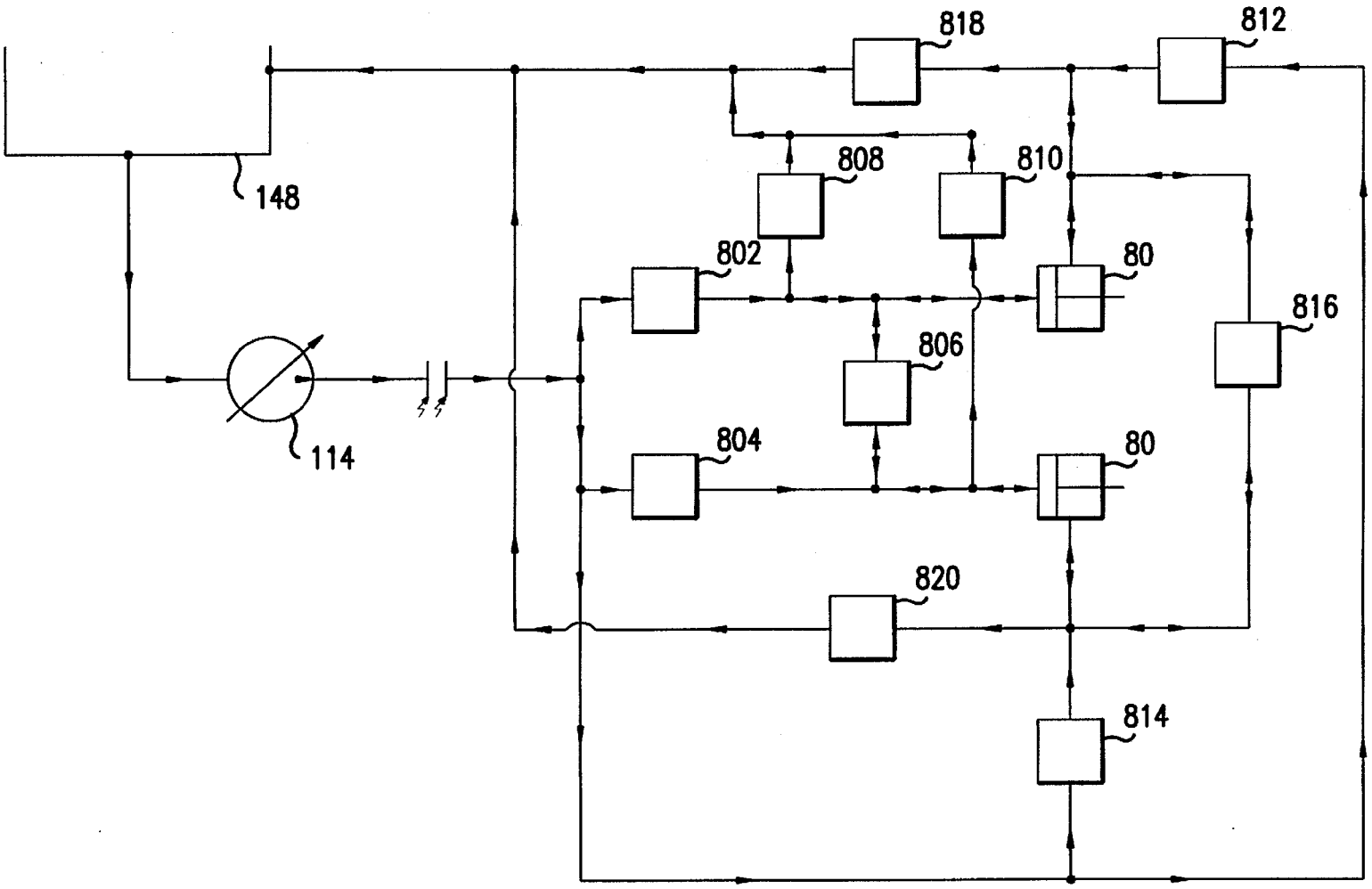
FIG. 12B is a detailed view taken from FIG. 12 showing the vertical movement hydraulic system of the outriggers.

Referring now to FIG. 12B, which is, again, an detail view derived from FIG. 12 of the flow diagram for the vertical movement system of outrigger C. As described previously, each vertical hydraulic piston/cylinder set 80 of outrigger C is capable of independent control. This provides the operator with a great deal of flexibility in maintaining support on uneven terrain or when the load is unbalanced. Also, vertical hydraulic piston/cylinder sets 80 are provided with the optional capability of being operated in sync.

To extend independently the port vertical hydraulic piston/cylinder set 80, the operator of fork lift truck T manipulates the controls on control panel 9 to allow hydraulic fluid to flow through valve components 802 and 818, which respectively, causes hydraulic fluid to flow in a manner that pressurizes and depressurizes the respective respective top and bottom sides of the piston of the port vertical hydraulic piston/cylinder 80. To retract the port outrigger C vertically and independently, the operator of fork lift truck T manipulates the controls on control panel 9 to cause hydraulic fluid to flow through valve components 812 and 808, which, respectively, pressurizes and depressurizes the lower side and the upper side of the piston of the port piston/cylinder set 80.

To extend independently the starboard vertical hydraulic piston/cylinder set 80, the operator of fork lift truck T manipulates the controls on control panel 9 to cause hydraulic fluid to flow through valve components 804 and 820, which, respectively, permits hydraulic fluid to flow so as to pressurize and depressurize the top and bottom sides of the piston of the starboard vertical hydraulic piston/cylinder 80. To retract the starboard outrigger C, vertically and independently, the operator of fork lift truck T manipulates the controls on control panel 9 to cause hydraulic fluid to flow through valve components 814 and 806, which, respectively, pressurizes and depressurizes the lower side and the upper side of the piston of the starboard piston/cylinder set 80.

To provide synchronous control of the vertical movement of both outriggers C, valve components 806 and 816 are provided and broadly represent, solenoid operated shutoff valves with connections as shown, or directional valves with two positions and four connections, two of which are connected to the main supply and return lines, the other two connected to the supply/return line of each piston/cylinder set 80, and an arrangement that closes the valve. In any case, valve components 806 and 816 provide the operator with the means to operate piston/cylinder sets 80 in sync by providing that their supply lines are common and that their return lines are common.

Like the proverbial ant, fork lift T of the present invention can lift a weight many times its own. To remove a load that is, for example, one and a half times the weight of fork lift truck T, from the flat bed of a truck, fork lift truck T approaches the load and by means of lazy tong extension system B and piston/cylinder sets 28, inserts forks 46 below the load in preparation of lifting. Outriggers C are extended horizontally their whole length or until a substantial obstacle is encountered. When one outrigger C encounters a substantial obstacle, for example, a rear truck tire, (as often is the case), it remains stationary while the other outrigger C continues to extend until it too meets a substantial obstacle or is fully extended. Outriggers C are then deployed vertically in an independent fashion; unless the operator is confident of the level of the surface and the evenness of the load, wherein the operator can deploy outriggers C in a synchronous fashion. Regardless, given a staggered fashion of the horizontal placement of the outrigger, the operator can decide to place more emphasis to the vertical support of one outrigger C than the other to compensate for the asymmetrical moment arm due to the uneven horizontal placement. In any case, or for whatever reason, the operator can vertically deploy the outriggers C with consideration to the terrain, the load, and other factors at the work site. Fork lift truck T thereafter lifts the load vertically off the bed of the flat bed truck with tines 46. The placement of outriggers C substantially reduces, and in many cases negates, the moment arm caused by this load which is one and a half times weight of fork lift truck T. Thus, fork lift truck T does not pitch forward in response to this load. Lazy tong horizontal extension system B is then retracted bringing the elevated load to a horizontal position between wheels 2 and 4 fork lift truck T. If it is desired, mast A can be tilted backward, during or after this operation to provide three dimensional support to the load. With the load elevated over the middle section of fork lift truck T, the load may be safely lowered and outriggers C retracted both vertically and horizontally to their rest positions.

The load is now transported safely and efficiently, and without pitching due to the load on tines 46, to its appointed place wherein the operation is reversed and the load is safely and easily stowed away.

Mast assembly A provides the capability of lifting wheels 2 off the ground so that they or wheel hub motors 2*a* may be easily inspected or repaired.

Fork lift truck T may easily be transported "piggy-back" style on the back of any vehicle that has tine sockets and suitable clearance from the ground, such as a flat bed truck. To secure fork lift truck T "piggy-back" style to the back end of a flat bed truck, fork lift truck T approaches the back end of the flat bed truck with lazy tong extension system B (thus, mast assembly A) in its fully retracted position. Forks 46 are inserted into their sockets at the back of the flat bed truck. When tines 46 are fully and securely inserted into the tine sockets, negative lift is applied to mast assembly A. Thus, fork lift T is lifted off the ground and continues to be lifted until fork lift truck T has sufficient and safe clearance from the ground and fork lift truck T is in firm contact with the underside of the flat bed truck. Fork lift truck T is then further secured to the flat bed truck with chains or cables and is ready to be transported.

The foregoing disclosure and description of the invention are illustrative and explanatory thereof, and various modifications in the size, shape and materials, as well as the details of the illustrated construction may be made without departing from the spirit of the invention. For example, a single hydraulic mast piston/cylinder combination 28, centrally mounted on stationary frame S to move moveable frame M vertically in static equilibrium may be substituted for the two hydraulic mast piston/cylinder combinations 28 described hereinbefore. Also, automatic outrigger levelling systems, of the types well-known in the art, may be substituted for the manual levelling system of outriggers C. Still further, hydraulic motors and pumps having variable displacement pistons may be provided for appropiate velocity and power adjustments.

Having disclosed our invention, what we claim as new and to be secured by Letters Patent of the United States is:

1. An improved fork lift truck comprising:

a U-shaped horizontal frame, disposed essentially at a lowermost section of said fork lift truck, said frame forming substantially parallel horizontal legs, said legs having a transversely connected end and an open end;

a horizontal motion system disposed essentially on a horizontal plane between said legs and having a first end slidably mounted to said legs and a second end connected to said frame;

said horizontal motion system having lazy tongs, said lazy tongs has a scissor-like end and a jointed end, said horizontal motion system having power means operatively connected to said scissor-like end of said lazy tongs for extending toward said open end of said legs and retracting from said open end of said legs said first end of said horizontal motion system by said lazy tongs by respectively, drawing together and spreading out said scissor-like end; and a lift assembly mounted to said first end of said horizontal motion system.

2. An improved fork lift truck, as claimed in claim 1, wherein, said means operatively connected to said scissor-like end of said lazy tongs for extending toward said open end of said legs and retracting from said open end of said legs said first end of said horizontal motion system by said lazy tongs by respectively, drawing together and spreading out said scissor-like end comprises piston/cylinder means.

3. An improved fork lift truck, as claimed in claim 1, further comprising;

an outrigger connected to each said leg at said open end;

said outrigger having a first hydraulically operated means for horizontal extension from said legs; and said outrigger having a second hydraulically operated means for vertical extension to make firm contact with the ground.

4. An improved fork lift truck, as claimed in claim 3, wherein, said first hydraulically operated means for horizontal extension from said legs comprises control means whereby when said outrigger encounters an obstruction the horizontal extension is essentially stopped.

5. An improved fork lift truck, as claimed in claim 3, wherein, said first hydraulically operated means for horizontal extension from said legs comprises a horizontal member, said horizontal member having a first end telescopically connected to said leg, and a second end, said horizontal member extended and retracted from said leg by said first hydraulically operated means;

said second hydraulically operated means for vertical extension comprises a fixed vertical member having a first end coupled essentially perpendicularly to said second end of said horizontal member, and a further second end and a moveable vertical member having a first end telescopically connected to said fixed vertical member at said further second end of said fixed vertical member, and said moveable vertical member having a yet another second end having a pad for engaging the ground said moveable vertical member extended and retracted from said fixed vertical member by said second hydraulically operated means.

* * * * *